US007563082B2

(12) United States Patent
Pohler

(10) Patent No.: US 7,563,082 B2
(45) Date of Patent: Jul. 21, 2009

(54) SEWAGE HANDLING SYSTEM, COVER, AND CONTROLS

(75) Inventor: Donald M. Pohler, Rochester, NY (US)

(73) Assignee: Liberty Pumps Inc., Bergen, NY (US)

( * ) Notice: Subject to any disclaimer, the term of this patent is extended or adjusted under 35 U.S.C. 154(b) by 363 days.

(21) Appl. No.: 11/111,113

(22) Filed: Apr. 21, 2005

(65) Prior Publication Data

US 2006/0239829 A1 Oct. 26, 2006

Related U.S. Application Data

(62) Division of application No. 11/093,133, filed on Mar. 29, 2005.

(51) Int. Cl.
*F04B 23/00* (2006.01)
*F04B 49/04* (2006.01)
*F16J 15/14* (2006.01)

(52) U.S. Cl. ..... 417/423.14; 417/40; 417/331; 277/590; 277/603; 277/616; 174/50; 174/660

(58) Field of Classification Search ..... 52/20; 241/46.01; 417/40, 126, 127, 133, 331, 423.14; 277/590, 603, 616, 626; 174/50, 660
See application file for complete search history.

(56) References Cited

U.S. PATENT DOCUMENTS 4,080,104 A * 3/1978 Brown, Jr. ..... 417/17
4,246,676 A * 1/1981 Hallsworth et al. ..... 15/353
5,465,455 A * 11/1995 Allen ..... 15/319
5,553,794 A * 9/1996 Oliver et al. ..... 241/36
5,924,846 A * 7/1999 Arnold et al. ..... 417/36
6,059,208 A * 5/2000 Struthers ..... 241/46.01
6,305,410 B1 * 10/2001 Cook et al. ..... 137/363
6,322,326 B1 * 11/2001 Davis et al. ..... 417/40
6,430,757 B1 8/2002 Pohler
6,729,847 B2 * 5/2004 Rossman ..... 417/40
2004/0018094 A1 * 1/2004 Rossman ..... 417/40
2005/0034383 A1 * 2/2005 Allen ..... 52/200
2006/0093492 A1 * 5/2006 Janesky ..... 417/366

OTHER PUBLICATIONS

U.S. Appl. No. 11/093,133, filed Mar. 29, 2005, Pohler.

Zoeller Pump Co. Bulletin FM 2124, Section: 3.10.005, "Preassembled Sump Pump Systems," 1 pages.

Zoeller Pump Co. "Crawl Space Pumping System," from www.zoeller.com/zcopump/products/homeimprove/crawlspace.htm Jan. 24, 2005, 4 pages.

(Continued)

*Primary Examiner*—Devon C Kramer
*Assistant Examiner*—Leonard J Weinstein
(74) *Attorney, Agent, or Firm*—Patent Innovations LLC; John M. Hammond

(57) ABSTRACT

A cover assembly for covering a vessel comprising a main cover comprising at least a first outlet opening adapted for connection to a pipe, and a second opening surrounded by a flat region adapted for placement of a gasket; an access cover comprising a flat region adapted for mating with the flat region of the main cover; and provisions for the sealing of at least one cord passing between the main cover and the access cover. In other embodiments, the cover assembly is provided with an engagement feature adapted for engagement with a hook-shaped hanger rod. Sewage basin assemblies are also provided which incorporate these cover assemblies.

12 Claims, 10 Drawing Sheets

OTHER PUBLICATIONS

Saber Industries, "Saber Sump Pit" from www.saber.theengineer.com/main1/html.4 pages.

Commonly owned pending U.S. Appl. No. 10/963,191, "Sump Enclosure and Assembly," filed Oct. 12, 2004. A pdf copy of the Filing Receipt, specification, claims, drawings, Assignment Recordation Notice, and Assignment are being submitted herewith via EFS. The reference is listed as "Non-patent literature" because this patent application has not been published.

Six page excerpt of online product catalog literature downloaded on May 53, 2008 from the web site of Crane Pumps & Systems Inc.; URL http://www.cranepumps.com/cps/tech_data/BARNES/3EPKG-GR/BE3E-01.PDF.

* cited by examiner

SEWAGE HANDLING SYSTEM, COVER, AND CONTROLS

CROSS-REFERENCE TO RELATED PATENT APPLICATIONS

This application is a divisional application of copending patent application U.S. Ser. No. 11/093,133, filed on Mar. 29, 2005, the disclosure of which is incorporated herein by reference.

This invention relates in one embodiment to a liquid vessel and a cover thereof, and more particularly to a sewage handling system, a cover for a sewage basin, and control accessories disposed therein.

BACKGROUND OF THE INVENTION

1. Field of the Invention

A sewage handling system, a cover assembly for a sewage basin, and control accessories disposed within a sewage basin for receiving and distributing sewage via a pump housed in the basin.

2. Description of Related Art

In general, sewage may be distributed from a sewage source to a desired location by gravity flow or by pumping. For example, for residential sewage, all sources of sewage in the residence may be located higher than the public sewer or septic tank connection, and the sewage may be transported to the connection solely by gravity flow. However, if a sewage source is located at a lower elevation than the sewer line connection as often occurs, it becomes necessary to pump sewage uphill to the connection. For example, a toilet may be installed in a bathroom located in a basement where the sewer line connection is located higher than the toilet.

Sewage basin assemblies may be installed to deliver sewage from a source to the desired sewer line connection. These assemblies typically include a container having an inlet, where sewage is received from the sewage source, and a pump for pumping received sewage to an outlet of the container, the outlet for connection to a sewer line leading to the public sewer or septic tank. For example, Liberty Pumps of Bergen, N.Y. manufactures and sells sewage basin assemblies as the "370-Series" that comprise a polyethylene basin with an inlet nub adapted to be connected to a sewage source, a cover for the top of the basin, a pump mounted in the basin, and an outlet pipe extending from the pump to outside the cover. Such basins are rotationally molded in a multi-part mold having a part-line parallel to the basin bottom that dissects the body inlet nub. The various components also may be sold individually for custom assembly at a job site. The basin may be installed immediately beneath the foundation, for example, such that the top of the basin is flush with the foundation slab, or located underground beyond the foundation and backfilled with soil. In either case, the inlet to the ejector system is in connection with the sewage source, and the outlet is in connection with a line running to the public sewer, a septic tank or alternate sewage treatment device.

Heretofore, certain patents and publications have disclosed sewage basin assemblies, and related structures such as U.S. Pat. No. 6,305,410 of Cook et al., the disclosure of which is incorporated herein by reference. This patent discloses a sewage ejector system including a basin and top cover. The basin body thereof includes a generally cylindrical wall, a closed bottom, and an open top.

U.S. Pat. No. 6,430,757 of Pohler discloses a self-contained bathroom waste collection and disposal unit having a reservoir configured to operably retain a pump and a floatoperated switch. The reservoir cooperates with a primary cover having plumbing and electrical access ports, and a secondary cover free of connecting ports that is readily removed to permit convenient access to the reservoir, including the switch (e.g., to replace the switch) and the pump inlet (e.g., to remove clogs). The unit further includes integral, molded features for retaining the switch and pump in an operable position, such as e.g., a boss on the cover prevents displacement of the pump, and molded-in torque stops prevent rotational movement of the pump; thereby absorbing the torque of the pump as it operates and correspondingly reducing stress on plumbing joints. The unit further includes molded-in strengthening collars and recesses sized to assist in transporting and installing the unit.

Although these and other sewage basin assemblies may operate in a satisfactory manner with respect to the basic sewage handling function, there is a need for better accessibility to the internal components of the sewage basins, and for a greater ease of assembly and adjustability of certain components. Opportunities remain for improvement of sewage basin assemblies in order to address problems heretofore unsolved. There is a need for a sewage basin assembly having in particular a cover that provides improved fastening means, gaskets and seals, electrical connections, and plumbing connections, in order to simplify the installation, plumbing, wiring, and general assembly thereof. There is also a need to provide a sewage handling system having a lower height such that in circumstances in which such enclosure is to be placed in a pit, such pit may be relatively shallow, thereby enabling installation of such enclosure in a location where the soil depth is minimal, or where the pit must be hewn in bedrock. There is also a need to provide a sewage handling system having modular electrical control components and mounting hardware therefor, in order to simplify and reduce the time of assembly of such components into the sewage handling system. Accordingly, embodiments of the present invention are provided that meet at least one or more of the following objects of the present invention.

It is an object of this invention to provide sewage handling system with a cover that enables easy access to the components contained therein.

It is a further object of this invention to provide a sewage handling system with a modular float switch assembly that is easily installed and adjusted.

It is an object of this invention to provide a cover for a sewage basin with improved sealing means for the sealing of electrical cords passing therethrough.

It is an object of this invention to provide a cover for a sewage basin with increased structural strength.

It is a further object of this invention to provide a sewage handling system that is compact with respect to height, for installation in limited space.

SUMMARY OF THE INVENTION

In accordance with the present invention, there is provided a cover assembly for covering a vessel, said cover assembly comprising a main cover comprising at least a first outlet opening adapted for connection to a pipe, and a second opening surrounded by a flat region adapted for placement of a gasket; an access cover comprising a flat region adapted for mating with said flat region of said main cover; and cord sealing means for the sealing of at least one cord passing between said main cover and said access cover. In a further embodiment, said main cover further comprises a second outlet opening, adapted for connection to a second pipe, wherein at lest one of the pipes connected to said first or said second outlet openings is a vent connection pipe.

In accordance with the present invention, there is further provided a cover assembly for covering a vessel, said cover assembly comprising a main cover comprising at least a first outlet opening adapted for connection to a pipe, and a second opening surrounded by a flat region adapted for placement of a gasket, and an engagement feature adapted for engagement with a hook-shaped hanger rod; and an access cover comprising a flat region adapted for mating with said flat region of said main cover.

In accordance with the present invention, there is further provided a level switch assembly for detecting the level of a liquid surface comprising a hook-shaped hanger rod and at least one level switch attached to said hook-shaped hanger rod.

In accordance with the present invention, there is further provided a sewage handling system comprising a basin for receiving a liquid, said basin comprising a body with at least one inlet opening and an open top comprising a flat region adapted for receiving a cover assembly; a cover assembly comprising a main cover comprising at least a first outlet opening adapted for connection to a pipe, and a second opening surrounded by a flat region adapted for placement of a gasket, an access cover comprising a flat region adapted for mating with said flat region of said main cover, and cord sealing means for the sealing of at least one cord passing between said main cover and said access cover; and a pump disposed in said basin and operatively connected by a discharge pipe to said first outlet opening of said main cover.

In accordance with the present invention, there is further provided a sewage handling system comprising a basin for receiving a liquid, said basin comprising a body with at least one inlet opening and an open top comprising a flat region adapted for receiving a cover assembly; a cover assembly comprising a main cover comprising at least a first outlet opening adapted for connection to a pipe, and a second opening surrounded by a flat region adapted for placement of a gasket, and an engagement feature adapted for engagement with a hook-shaped hanger rod, and an access cover comprising a flat region adapted for mating with said flat region of said main cover; a level switch assembly comprising a hook-shaped hanger rod engaged with said engagement feature of said cover assembly, and at least one level switch attached to said hook-shaped hanger rod; and a pump disposed in said basin and operatively connected by a discharge pipe to said first outlet opening of said main cover.

BRIEF DESCRIPTION OF THE DRAWINGS

The invention will be described by reference to the following drawings, in which like numerals refer to like elements, and in which.

Figure 1:
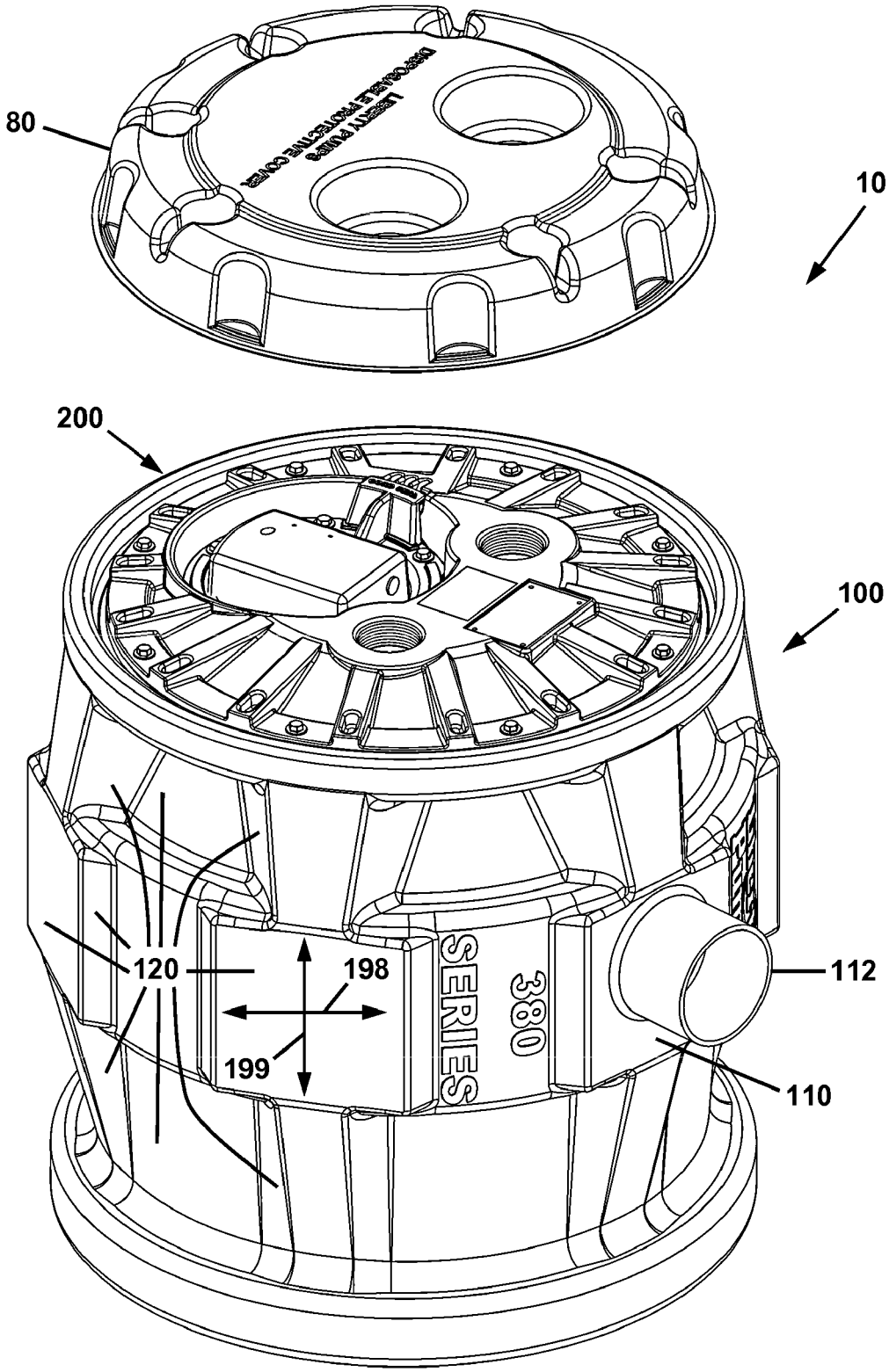
FIG. 1 is a perspective view of one embodiment of a sewage handling system including a basin, a structural cover, and a protective cover.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements.

Figure 2:
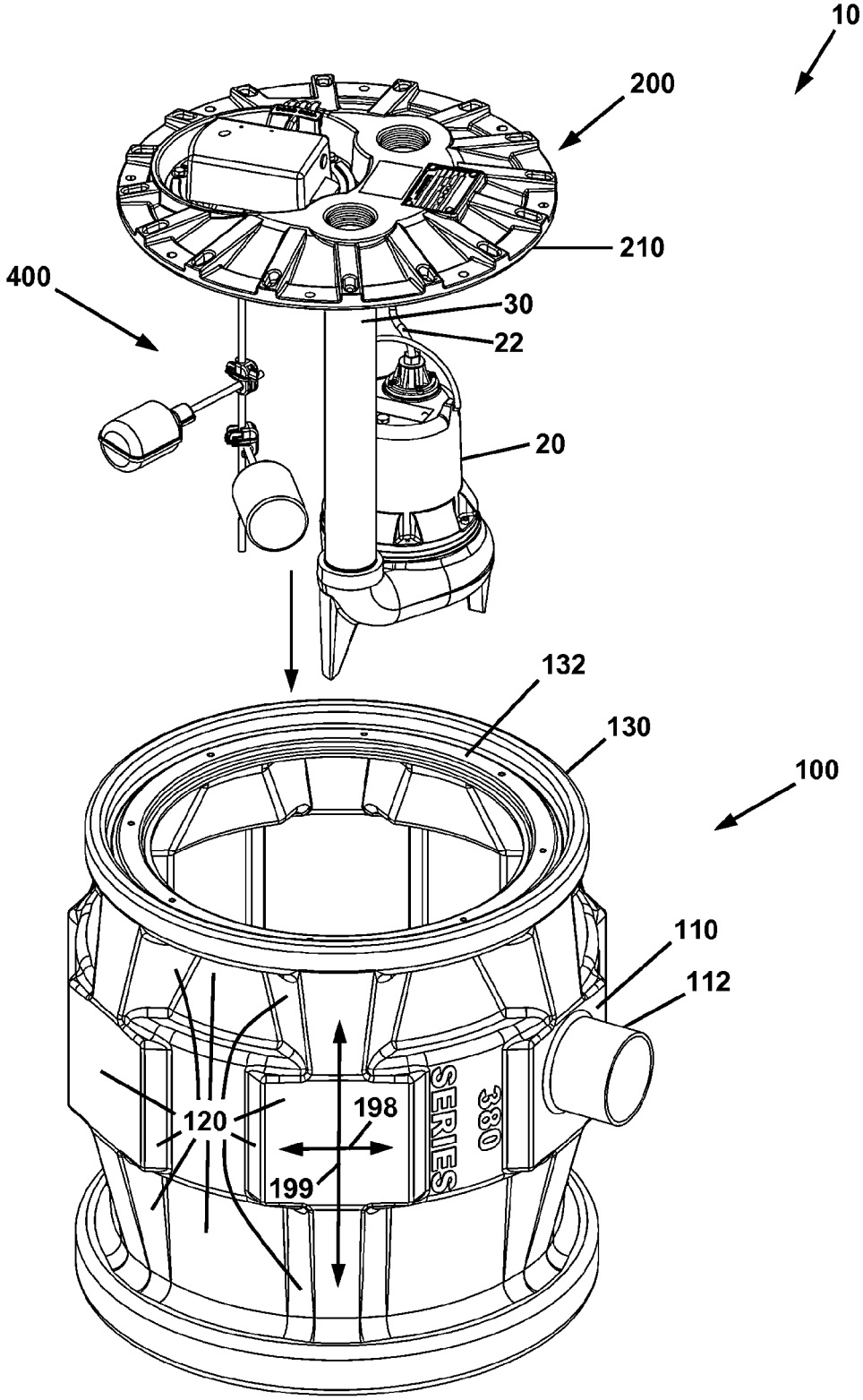
FIG. 2 is a partially exploded perspective view of the sewage handling system of FIG. 1.
Figure 3:
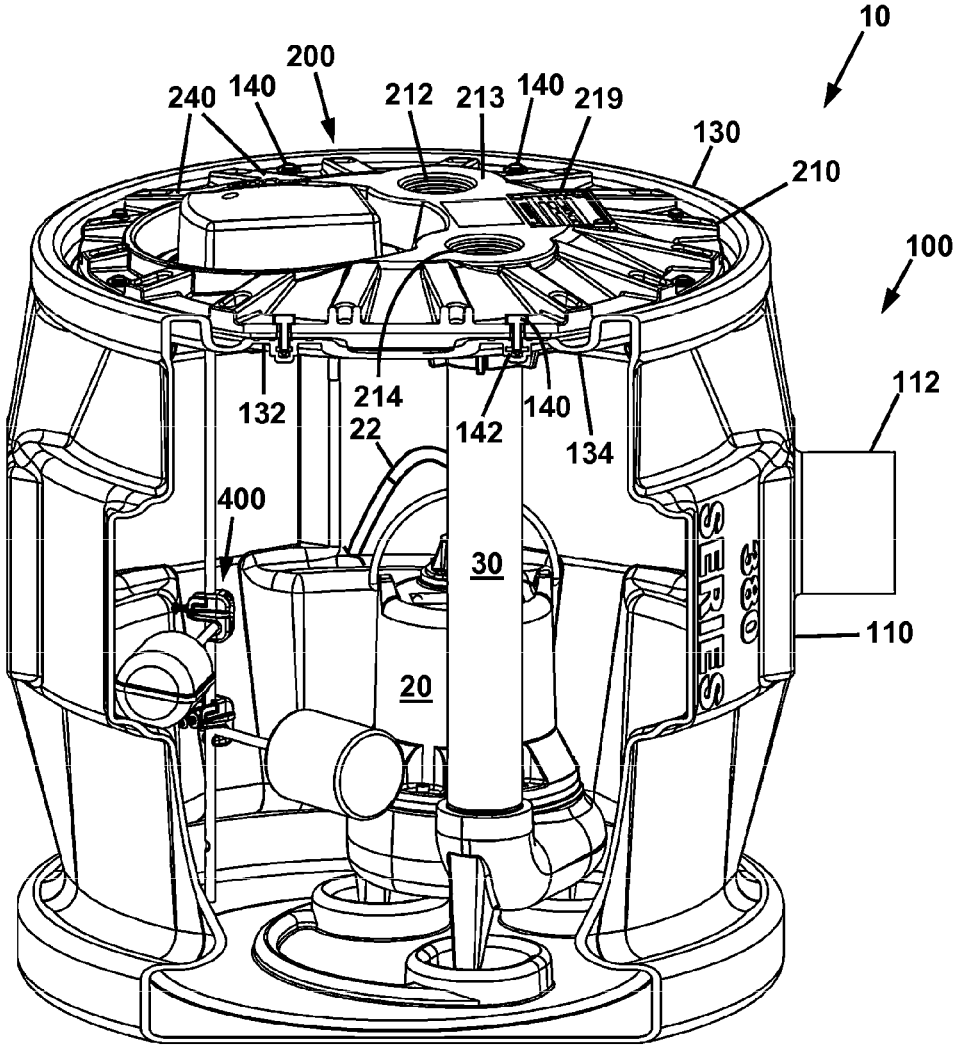
FIG. 3 is a cutaway perspective view of the sewage handling system of FIG. 1.

FIG. 1 is a perspective view of one embodiment of a sewage handling system including a basin, a structural cover, and a protective cover; FIG. 2 is a partially exploded perspective view of the sewage handling system of FIG. 1; and FIG. 3 is a cutaway perspective view of the sewage handling system of FIG. 1. Referring to FIGS. 1-3 sewage handling system 10 comprises a sewage basin 100, cover assembly 200, and float switch assembly 400. Basin 100 contains a pump 20 to which is connected a discharge pipe 30, that in turn is connected to an outlet port 214 in main cover 210.

After assembly of sewage handling system 10 at a manufacturing site, and prior to shipping, sewage basin assembly 10 may be fitted with protective cover 80, which provides protection to the cover assembly 200 of basin assembly 10 during shipping and during installation. The function of protective cover 80, and the preferred materials of construction thereof are substantially the same as disclosed in commonly owned pending application U.S. Ser. No. 10/963,191 the disclosure of which is incorporated herein by reference.

The general spatial relationships and functions of vessel or basin 100, pump 20, discharge pipe 30, and cover 210 are substantially the same as is described in U.S. Pat. No. 6,305,410 of Cook et al. Basin 100 is preferably between about 18 and 36 inches high. In one preferred embodiment depicted in FIGS. 1-3, basin 100 is provided with a height of about 24 inches. In the embodiment depicted in FIGS. 1-3, basin 100 is preferably also provided with at least one flat 110 and/or one hub 112 for connection of inlet piping thereto. In one preferred embodiment, basin 100 is further provided with a network of facets 120 formed in the wall and around the circumference thereof, effectively forming a structure having vertical ribs as indicated by bidirectional arrow 199, as well as horizontal ribs as indicated by bidirectional arrow 198, for even greater structural strength. Basin 100 is generally shorter in height than other sewage basins and thus has the advantage of a compact shape, which enables the use thereof in locations where the soil depth above bedrock or other subsurface obstructions (roots, buried cables and/or utility piping, etc.) is less than about thirty inches.

Cover 210 is preferably fastened to a flat region 132 of annular flange 134 formed at the upper edge 130 of basin 100 by the use of bolts 140 which pass through holes 280 (see also FIG. 8) in cover 210, or other suitable fastening means. In one preferred embodiment, basin 100 is provided with threaded inserts 142 molded into flange 134, for engagement with fasteners 140. Cover 210 is preferably provided with holes to accept either 8 or 16 equally spaced fasteners around the perimeter thereof for securing cover 210 to basin 100.

Figure 4:
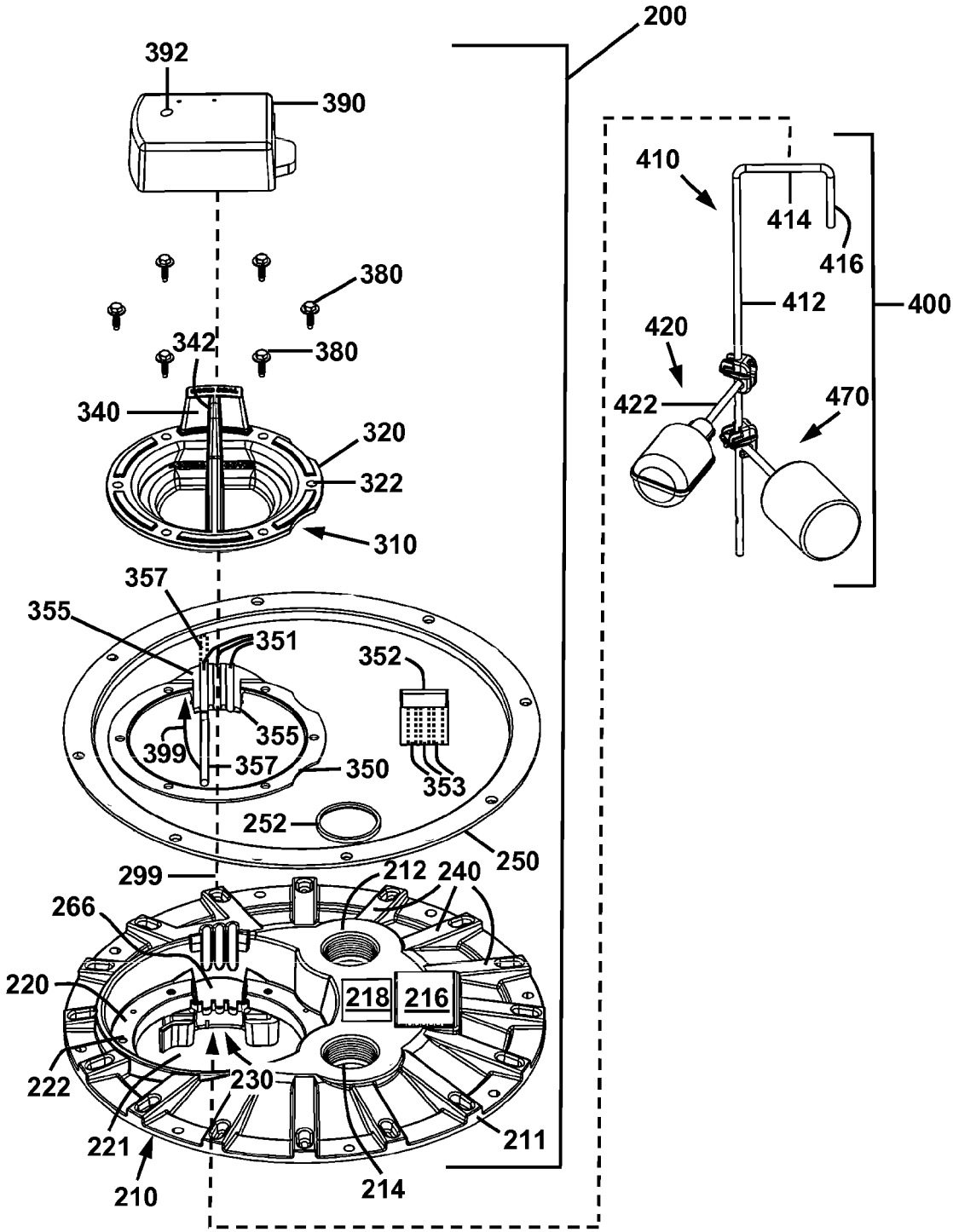
FIG. 4 is an exploded perspective view of the sewage handling system cover and float switch assemblies depicted in FIG. 2.
Figure 8:
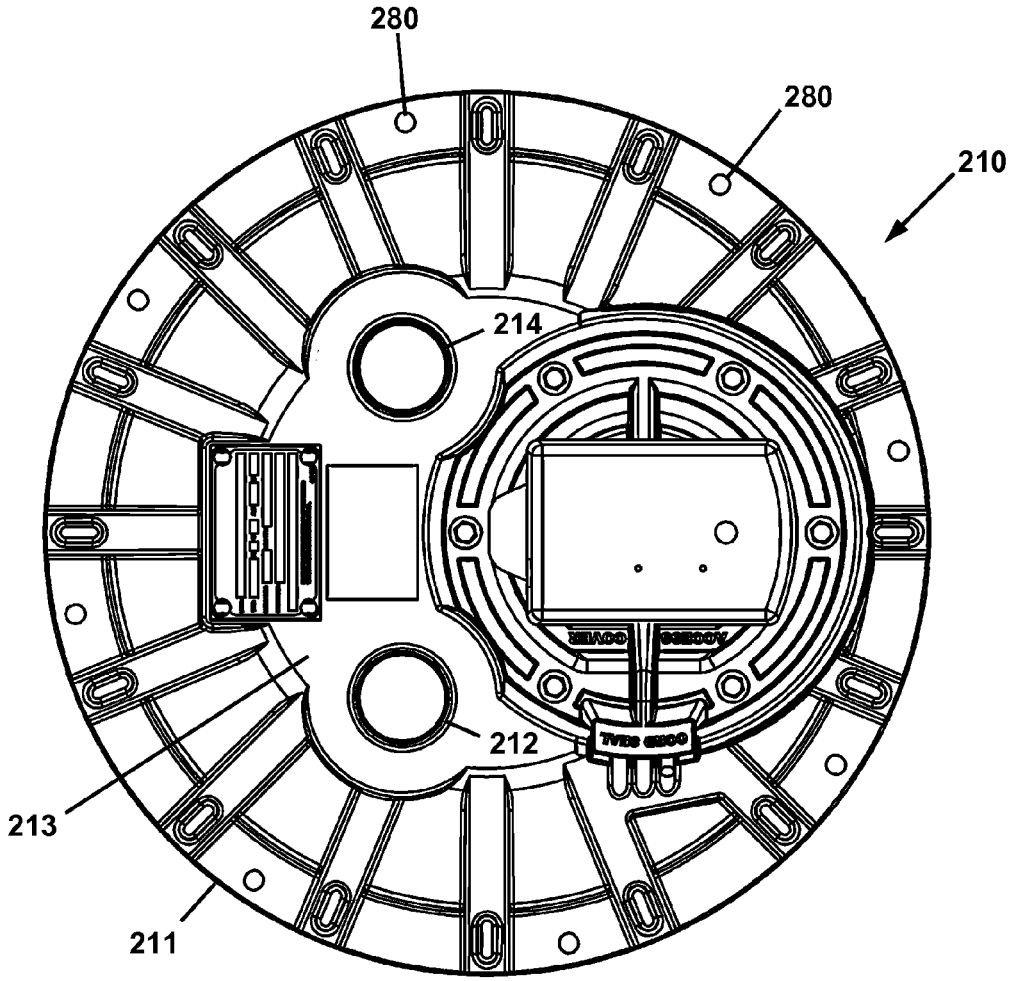
FIG. 8 is a top view of the main cover assembly of FIG. 2 in a fully assembled state.

Cover assembly 200 and cover 210 are further provided with numerous advantageous features to be described presently with reference in particular to FIGS. 3, 4, and 8. FIG. 4 is an exploded perspective view of the sewage handling system depicting cover assembly 200, and FIG. 8 is a top view of the system cover assembly 200 in a fully assembled state. Referring to FIGS. 3, 4, and 8, cover assembly 200 comprises main cover 210 and access/inspection cover 310. Main cover 210 is provided with a flat flange 220 formed therein having a plurality of holes 222 and threaded inserts 224 (see also FIG. 5) molded into flange 220. Access cover 310 is also provided with a flat flange 320 having a plurality of holes 322 formed therein, such that access cover 310 may be secured to main cover 210 by bolts 380 when flange 320 is mated with flange 220.

Cover assembly 200 further comprises a gasket 350 that is disposed between main cover 210 and access cover 310 to provide a liquid tight seal between such covers. Cover assembly 200 further comprises another gasket 250 that is disposed between main cover 210 and flat region 132 of flange 134 of basin 100 for a liquid tight seal therebetween. For the sake of simplicity of illustration in FIG. 4, gasket 250 is shown above cover 210; however, it is to be understood that gasket 250 is disposed beneath cover 210 when cover 210 is fastened to basin 100.

Figure 7:
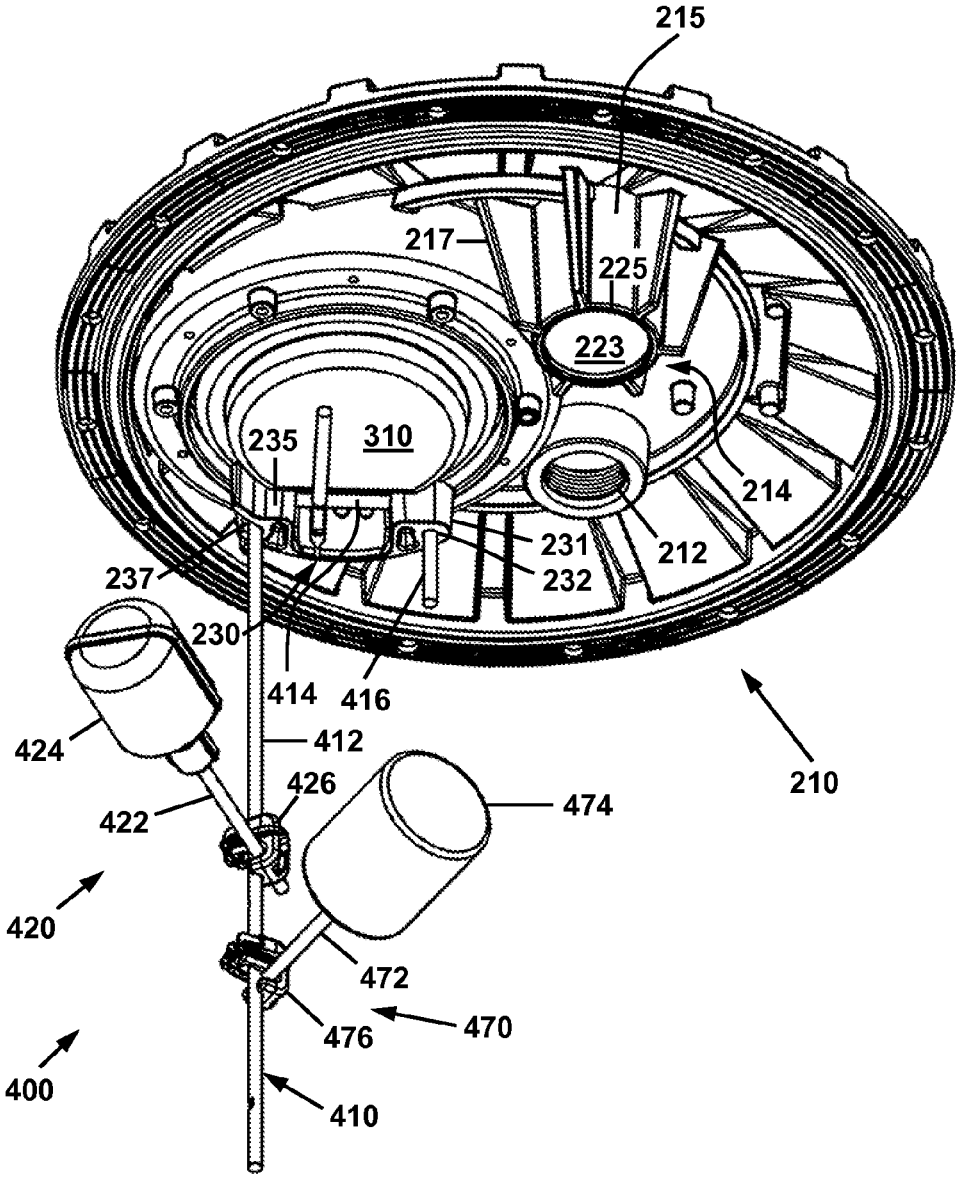
FIG. 7 is a perspective view of the main cover and float switch assemblies of FIG. 2, taken from a vantage point below the lower portion of the main cover.

In the preferred embodiment, cover assembly 200 further comprises a lip seal 252 that seals discharge pipe 32 (see FIG. 2) to outlet opening 214. Referring to FIG. 2 and FIG. 7 in particular, outlet opening 214 of main cover 210 is formed as an elongated cylinder 215 that is reinforced by gussets 217. Outlet opening 214 further comprises a hollow socket 223 into which discharge pipe 30 is inserted during assembly of system 10. Lip seal 252 is disposed in cylindrical recess 225 and around discharge pipe 30, thereby sealing discharge pipe 30 to cover 210.

When sewage handling system 100 is installed and in operation, access cover 310 is easily removed from cover 210 without the need for disconnection of any piping or electrical components. Access cover 310 thus provides ready access to float switch assembly 400 (to be described subsequently herein) and to pump 20, and for general inspection of the contents and condition of basin 100. Access cover 310 is easily replaced and resealed to main cover 210 when the need for access to basin 100 is finished.

In the embodiment depicted in FIGS. 3, 4, and 8, cover 210 is depicted as being provided with threaded outlet openings 212 and 214, such as e.g. 2 inch pipe thread. Other suitable pipe connections may also be used, such as is described and shown in FIGS. 22A-23 of commonly owned U.S. provisional patent application Ser. No. 60/487,953 of Cook et al., the disclosure of which is incorporated herein by reference.

Cover 210 is further provided with two flat recessed areas 216 and 218 to which product identification labels, such as e.g., label 219 of FIG. 3 may be fastened. Cover 210 is further provided with a plurality of ribs 240 disposed around the outer region thereof in the radial direction, which provide additional structural strength to cover 210. The upper surfaces of ribs 240 are preferably sloped upwardly from the outer perimeter 211 to the flat region 213 of cover 210. This upward slope is best seen with reference to FIG. 10, and provides greater strength to withstand vertical loads upon cover 210.

Figure 5:
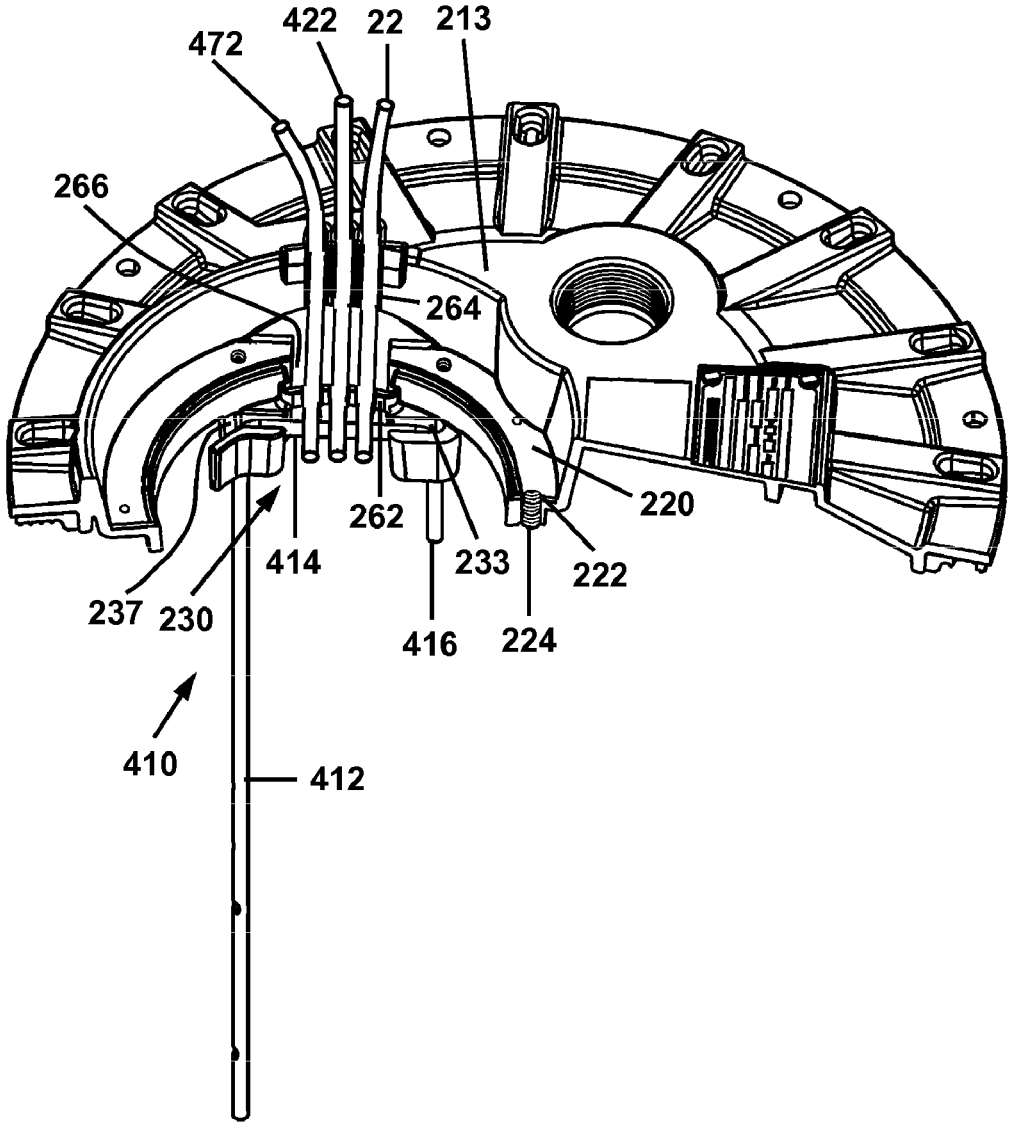
FIG. 5 is a cutaway perspective view of the main cover of FIG. 4 shown with the float support hanger rod of FIG. 4 engaged therewith.
Figure 9:
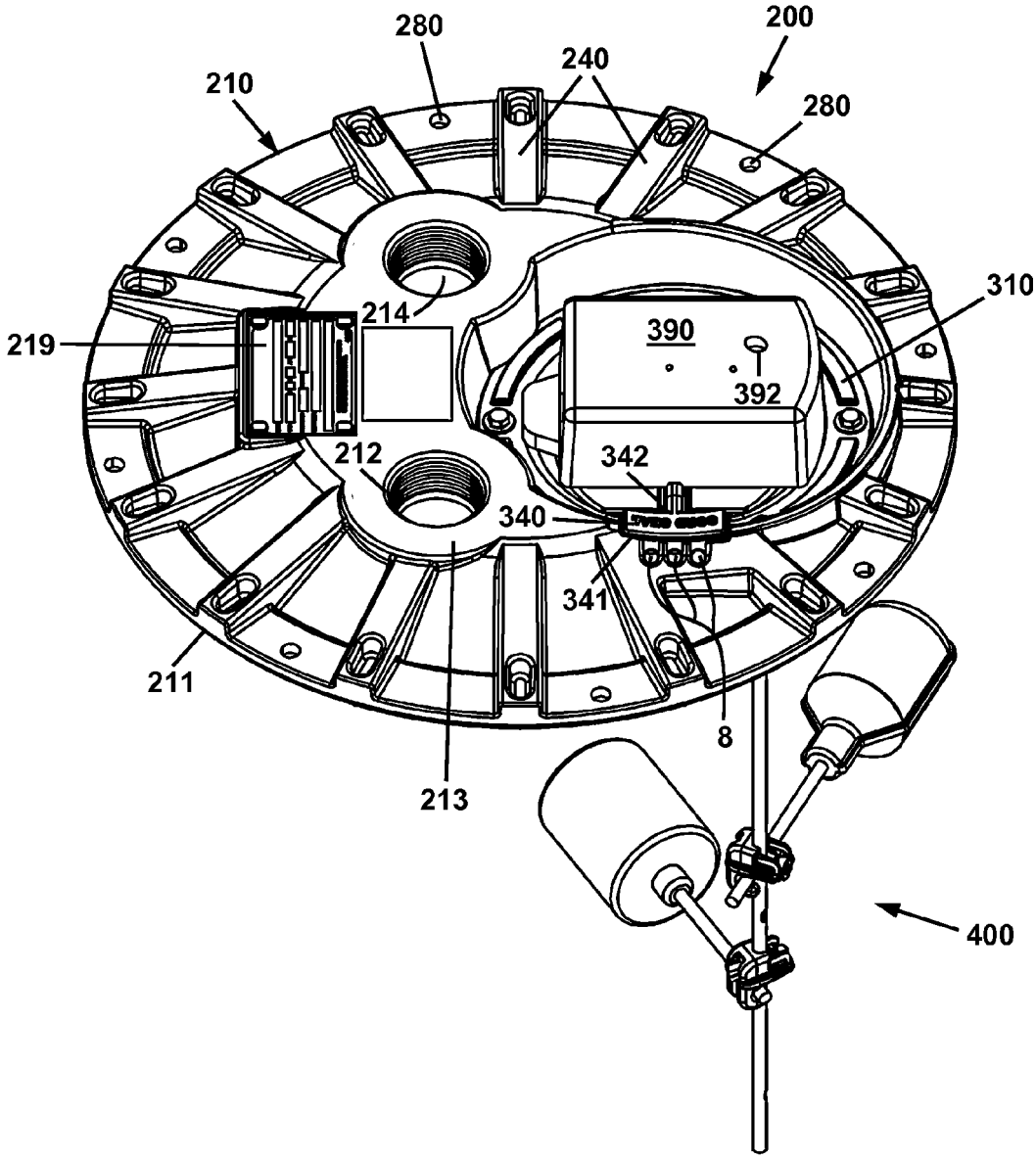
FIG. 9 is a perspective view of the main cover and float switch assemblies of FIG. 2 in a fully assembled state, taken from a vantage point that depicts the cord passageways therethrough.

One of the more advantageous features of cover assembly 200 is the provision of cord sealing means integrated therein. This provision has eliminated the need for separate cord sealing fittings to be provided in cover assembly 200. In one preferred embodiment, such cord sealing means is provided in the interface between main cover 210, access cover 310, and gasket 350 disposed therebetween, and is best understood with reference in particular to FIGS. 4, 5, and 9. FIG. 5 is a cutaway perspective view of main cover 210 of FIG. 4 showing a portion of the cord sealing means, and FIG. 9 is a perspective view of cover assembly 200 in a fully assembled state, taken from a vantage point that depicts the cord passageways through the cord sealing means thereof, and the cords disposed therein. Referring to FIGS. 4 and 5, main cover 210 is provided with a plurality of cord grooves in which cords such as e.g., cords 22, 422, and 472 may be disposed. In the preferred embodiment, main cover 210 is provided with lower cord grooves 262 and upper cord grooves 264, with the lower cord grooves being beneath the level of flange 220, and the upper cord grooves extending at an upward angle from near the level of flange 220 upwardly to the level of top surface 213 of cover 210.

A gap is provided between the upper extremity of lower cord grooves 262 and the lower extremity of upper cord grooves 264. In this gap there is formed a pocket 266 for receiving and holding a cord sealing portion 355 of cover gasket 350. Although in FIG. 5, for the sake of simplicity of illustration, cords 472, 422, and 22 are depicted as being disposed directly into cord grooves 262 and 264, it is preferable that in the assembled state, cords 472, 422, and 22 are disposed between cord sealing portion 355 of access cover gasket 350 and cord seal block 352. Cover gasket 350 is also provided with a corresponding set of cord seal grooves 351 to match lower cord seal grooves 262 and to hold cords 22, 422, and 472; and cord seal block 352 is also provided with a corresponding set of cord seal grooves 353 on the outer side thereof to hold cords 22, 422, and 472. Access cover 310 is provided with a cord seal riser 340 with an angled flat surface formed on the outer side 341 thereof, i.e. the side opposite gusset 342, to match the flat surface on the inner side of cord seal block 352.

To assemble access cover 310 to main cover 210 and seal cords 472, 422, and 22 therebetween, cover gasket 350 is placed upon flange 220 of cover 210; cords 22, 422, and 472 are run through the opening 221 for access cover 310 and are pressed into cord seal grooves 351 of cover gasket 350; cord seal block is placed over cords 22, 422, and 472 and in contact with the cord sealing portion 355 of cover gasket 350, so that cords 22, 422, and 472 are disposed in the passageways 8 formed between cord seal grooves 351 of cover gasket 350 and cord seal grooves 353 of cord seal block 352; access cover 310 is placed upon main cover 210 with the flat surface of cord seal block 352 mated against the angled flat surface of the riser 340 of access cover 310; and bolts 380 are used to secure access cover 310 to main cover 210, thereby compressing gasket 350 therebetween. Referring to FIG. 9, which is a perspective view of cover assembly 200 taken from the angle at which the cords therein are upwardly disposed, it can be seen that cords 22, 422, and 472 are routed through holes 8 and are sealed between the cover gasket 350 and the cord seal block 352, by the clamping action of access cover 310 against main cover 210, which compresses gasket 350 and cord seal block 352 to provide such sealing action.

Referring again to FIGS. 4 and 9, and in a further embodiment, the applicant's cover assembly 210 is further provided with alarm control unit 390, which, during shipping to the installation site, is disposed upon access cover 310. When sewage handling system 10 is installed, alarm control unit 390 is mounted at a suitable location nearby, such as e.g., a nearby wall, or on a sheet metal panel or other suitable surface. Referring also to FIG. 5, in the preferred embodiment, the cord 422 of alarm level switch 420 is fed upwardly through one of the cord openings formed between cord sealing portion 355 of access cover gasket 350 and cord seal block 352, and into an opening 392 in alarm control unit 390 that is mounted nearby. (For the sake of simplicity of illustration, cord 422 is not shown disposed through opening 392 in FIG. 9. However, it is to be understood that cord 422 enters control unit 390 through opening 392 and is suitably sealed at such opening.)

Electrical wires (not shown) within cord 422 are connected to further electrical switching means such as e.g. an electromechanical relay, or to communication means such as e.g. a wireless transmitter. Such further electrical switching means or communication means is further connected to or in communication with various alarm indicating means such as e.g. a light, a horn, a computer or process controller, including a video display, and the like. In operation, when the liquid level in basin 100 becomes excessively high and floats level switch 420 upwardly, the contacts within level switch 420 change state (open-to-closed or vice-versa), and an alarm condition is indicated by the alarm indicating means.

Figure 6:
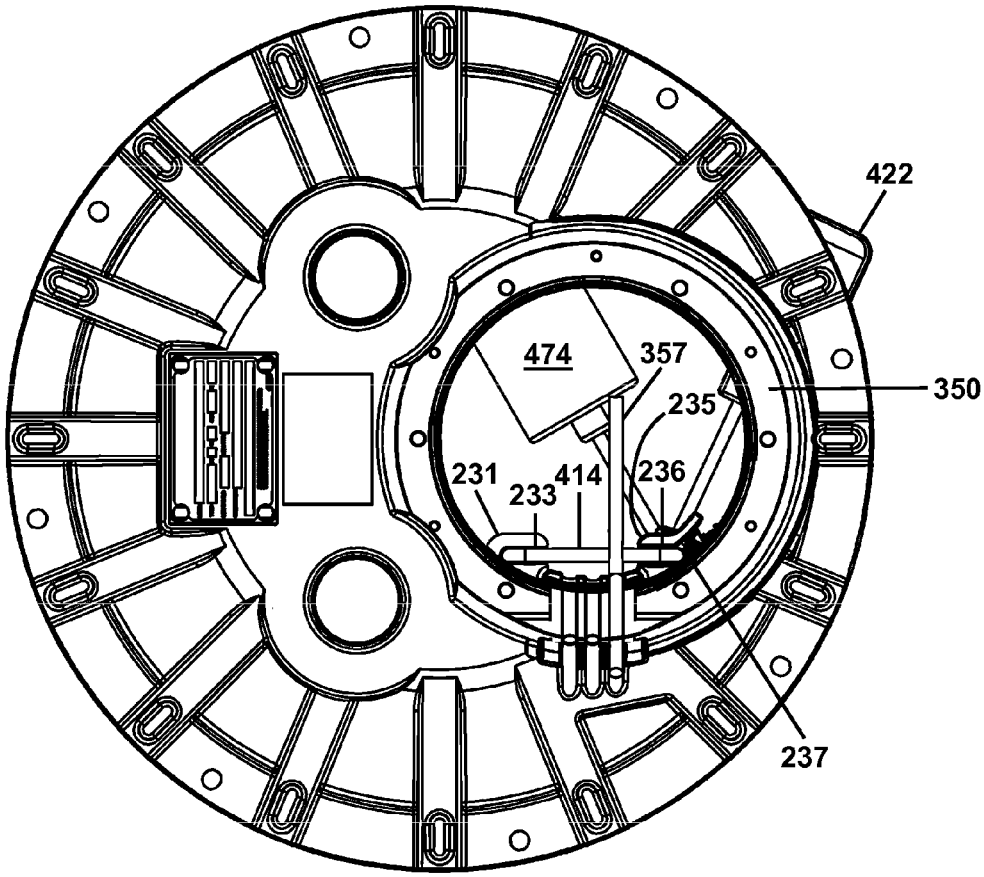
FIG. 6 is a top view of the main cover and float switch assemblies of FIG. 4, with the access cover removed from such main cover.
Figure 10:
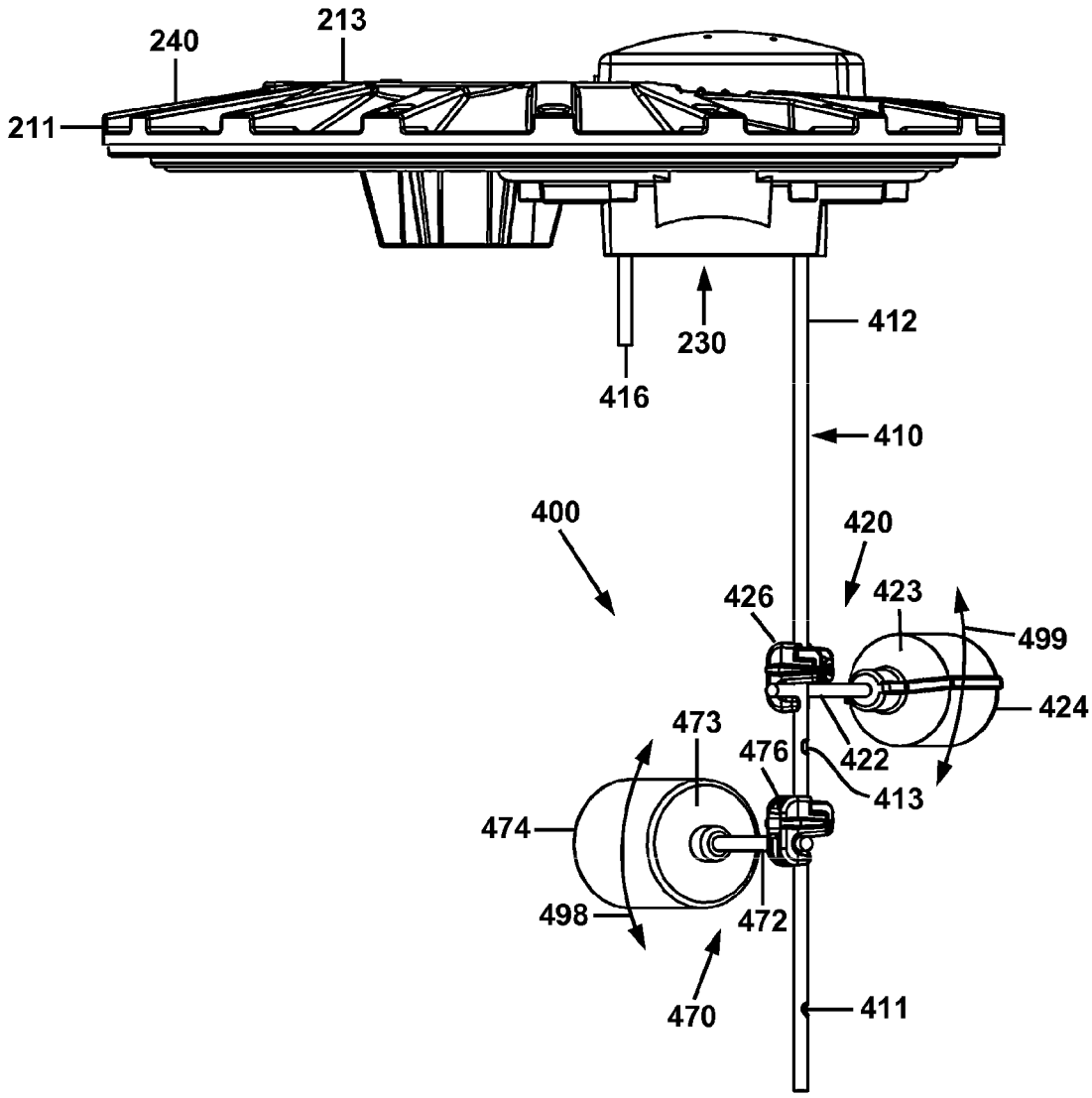
FIG. 10 is a side view of the main cover and float switch assemblies of FIG. 2 in a fully assembled state.

A more detailed description of the level control means of the applicant's sewage handling system is now provided, such level control means being one of the more advantageous features of sewage handling system 10. Such level control means is easily installable, removable, and adjustable. This provision, together with the provision of access cover 310, enables easy installation of level switches during assembly of sewage handling system 10, and subsequent removal, replacement, and/or adjustment at any time thereafter. In one preferred embodiment, such level control means comprises one or more float-type level switches mounted on a removable hanger rod, and is best understood with reference in particular to FIGS. 4-7 and FIG. 10. FIG. 4 is an exploded perspective view of the sewage handling system cover assembly 200 and float switch assembly 400 depicted in FIG. 2; FIG. 5 is a cutaway perspective view of the main cover of FIG. 4 shown with the float support rod of float switch assembly 400 of FIG. 4 engaged therewith; FIG. 6 is a top view of the main cover and float switch assemblies of FIG. 4, with the access cover removed from such main cover in order to view float switch assembly 400 therebeneath; FIG. 7 is a perspective view of the main cover and float switch assemblies of FIG. 2, taken from a vantage point below the lower portion of the main cover; and FIG. 10 is a side view of the main cover and float switch assemblies of FIG. 2 in a fully assembled state.

Referring to FIGS. 4-7 and FIG. 10, float switch assembly 400 comprises hanger rod 410, a first float switch 420 and preferably a second float switch 470. Hanger rod is preferably formed as a hook with an inverted J-shape, and comprises an elongated vertical section 412, a cross bar section 414, and a short vertical section 416, with sections 412 and 414 and sections 414 and 416 being joined at junctions of approximately 90 degrees. In one preferred embodiment, hanger rod 410 is formed of a 5/16-inch diameter stainless steel rod that is bent to form the 90 degree junctions. In an alternate embodiment, (not shown), hanger rod may have a hook shape comprising a simple L-shape, wherein the horizontal portion of the L is engaged with an engagement feature in cover 210. In other embodiments (not shown), the hook shape may be formed as a T-shape, or as a small flange, with the operative requirement being that hanger rod hooks onto and is supported by an engagement feature in cover 210.

In the preferred embodiment depicted in FIGS. 4-7 and FIG. 10, elongated vertical section 412 of hanger rod 410 is provided for the securing and locating of float switches thereupon. The upper portion of elongated section 412, cross bar 414, and short vertical section 416 form a hook shape, which may be engaged with a suitable engagement feature in cover assembly 200. In the preferred embodiment, there is provided an engagement feature 230 in main cover 210 for the attachment and suspension of hanger rod 410 and float switch assembly 400 therebeneath. Referring again to FIGS. 5-7 and FIG. 10, engagement feature 230 comprises a first section 231 having a horizontal channel 233, which transitions to a vertical hole 232. First section 231 is formed to accommodate a portion of cross bar 414 and short vertical section 416, and the 90 degree elbow therebetween, of hanger rod 410. Engagement feature 230 further comprises second section 235 having horizontal channel 236, which transitions to vertical notch 237. Second section 235 is formed to accommodate a portion of cross bar 414 and elongated vertical section 412, and the 90 degree elbow therebetween, of hanger rod 410.

It will be apparent that alternatively, vertical hole 232 could instead be formed as a vertical slot similar to vertical notch 237, and still receive vertical section 416 of rod 410. It will be further apparent that rod 410 could be formed with a hook shape other than a right-angled J-shape, such as an arcuate J-shape, with the corresponding channel-and-notch or hole cavity structure being formed in a corresponding shape to receive such hook shape. A right angle J is preferred, however, for ease of manufacturing. It will also be apparent that hook-shaped rod 410 could be provided with two elongated sections forming a U-shape, or even branches of elongated sections for the attachment of level control means, and other control means thereto.

Referring in particular to FIGS. 5 and 6, in the assembled state, hanger rod 410 is engaged with engagement feature 230 of cover 210 such that short vertical section 416 is disposed in hole 232, elongated section is disposed in notch 237, and cross bar 414 is disposed in channels 233 and 236. Thus hanger rod is easily and removably engaged with and hung from engagement feature 230 of cover 210. For the sake of simplicity of illustration, float switches 420 and 470 are not depicted in FIG. 5; however it is to be understood that in operation, at least one float switch, and preferably two float switches are provided as depicted in FIGS. 2-4, 6-7, and 9-10. In the preferred embodiment wherein two float switches 420 and 470 are present, the lower of the two float switches, i.e., float switch 470 is used for on-off operation of pump 20 (see FIG. 2), and the higher of the two float switches, i.e., float switch 420 is used as an alarm switch that provides an indication of when basin 100 is excessively full, and possible intervention is required.

Referring now in particular to FIG. 10, and in the preferred embodiment depicted therein, cord 422 of float switch 420 is secured to elongated vertical rod 412 by clamp 426, or by other suitable means, such as plastic cable ties and the like. In like manner, cord 472 of float switch 470 is secured to elongated vertical rod 410 by clamp 476. Clamps 426 and 476 secure flexible cords 422 and 472 to elongated vertical rod such that floats 424 and 474 rise and fall vertically as indicated by arrows 499 and 498 respectively. Cords 422 and 472 are flexible and act as tethers to floats 424 and 474. Thus, such floats also rotate such that the central axes of such floats are oriented in a "downward" direction when the liquid level is beneath such floats, i.e. the cord end 423 of float 424 faces upwardly, and cord end 473 of float 474 faces upwardly. When the liquid level rises above the attachment points of clamps 426 and 476, floats 424 and 474 rotate such that the central axes of such floats are oriented in an "upward" direction, i.e. the cord end 423 of float 424 faces downwardly, and cord end 473 of float 474 faces downwardly. Switching means are contained within floats 424 and 474 so that at some point during these rotational transitions, electrical contacts are switched, indicating the rising or falling of liquid level above or below such float switches. It is to be understood that in FIGS. 2-10, cords 22, 422, and 472 are shown as being terminated near their respective components, but that such cords run continuously up through the cord sealing means described herein.

It will be apparent that many different types of float switches may be affixed to rod 412 to provide level control capability for system 10. By way of illustration, and not limitation, a Model 61130A0 10PMD1WP float switch manufactured by the SJE-Rhombus Corporation of Detroit Lakes, Minn. may be used. For the sake of simplicity of illustration in the Figures provided herein, the cords of such float switches are not shown. However, it is to be understood that in FIGS. 2-10, cords 22, 422, and 472 run continuously up through the cord sealing means described herein.

In one embodiment, float switch assembly 400 of sewage handling system 10 is provided with only a single float switch, which functions to provide switching for on-off operation of pump 20 (see FIG. 2), However, in the preferred embodiment depicted in the Figures herein, there is provided a system 10 with a float switch assembly 400 having two switches 420 and 470. In operation, the function of upper switch 420 is to provide high liquid level alarm capability, and the function of lower switch 470 is to provide switching for on-off operation of pump 20 as recited previously. It will be apparent that the level setpoints of each of these switches 420 and 470 may be varied by adjusting the positions thereof on elongated vertical rod 412. In the preferred embodiment, rod 412 is provided with a plurality of notches 411, 413, etc., or other suitable reference etchings or indicia for the desired placement of float switches 420 and 470 on rod 412.

It will also be apparent that alternatively, such engagement feature 230 could be provided in access cover 310, so that when access cover 310 is unbolted and lifted from cover 210, level switch assembly 400 is also removed from basin 100. It is preferable, however, that level switch assembly 400 be left in place, and that the removal of access cover 310 simply provides access to level switch assembly 400 and other components of basin 100.

In the preferred embodiment depicted in the Figures herein, wherein sewage handling system 10 comprises a pump 20, a first float switch 420 and a second float switch 470, there is a total of three cords 22, 424, and 474 (see FIG. 5) to be sealed by the cord sealing means described herein. In the event that system 10 is provided with a pump 20 and only one float switch 420, and only two cords 22 and 424 to be sealed, access cover gasket 350 is provided with a hinged finger 357 that may be placed in one of cord sealing grooves 351 of gasket 350. Referring to FIGS. 4 and 6, sealing finger 357 is formed as an integral part of gasket 350, and is hingably attached thereto. If only two cords are present to be sealed in cord sealing grooves 351, sealing finger 357 is hingably rotated upwardly as indicated by arrow 399 of FIG. 4, and is disposed in the corresponding sealing groove, thereby plugging such sealing groove when access cover 310 is secured to main cover 210.

It is therefore apparent that there has been provided, in accordance with the present invention, a sewage handling system, a sewage basin cover assembly, and a modular, easily installable, removable, and adjustable level control assembly for a sewage handling system. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A sewage handling system comprising:

a. a basin for receiving a liquid, said basin comprising a body with at least one inlet opening and an open top comprising a flat region;

b. a cover assembly disposed upon said flat region of said basin and comprising:

i. a main cover comprising at least a first opening, a second opening surrounded by a first flat flange, and an engagement feature comprised of at least one channel transitioning to a first cavity; and ii. an access cover comprising a second flat flange removably secured to said first flat flange of said main cover; and iii. a gasket disposed between said first flat flange of said main cover and said second flat flange of said access cover, and comprising a first portion of a cord seal including a first cord seal groove disposed in an interface between said main cover and said access cover; a second portion of said cord seal comprised of a cord seal block including a second cord seal groove; wherein said cord seal block is in contact with said first portion of said cord seal, thereby forming a cord seal passageway between said first cord seal groove of said first portion of said cord seal and said second cord seal groove of said cord seal block;

c. a level switch assembly comprising a hook-shaped hanger rod engaged with said engagement feature of said cover assembly, and at least one level switch attached to said hook-shaped hanger rod; and d. a pump disposed in said basin and operatively connected by a discharge pipe to said first opening of said main cover.

2. The sewage handling system as recited in claim 1, further comprising an alarm control unit electrically connected to said at least one level switch through a first cord, wherein said first cord is disposed in said cord seal passageway.

3. A sewage handling system comprising:

a. a basin for receiving a liquid, said basin comprising a body with at least one inlet opening and an open top comprising a flat region;

b. a cover assembly disposed upon said flat region of said basin and comprising:

i. a main cover comprising at least a first opening, a second opening surrounded by a first flat flange, and an engagement feature comprised of at least one channel transitioning to a first notch; and ii. an access cover removably secured to said first flat flange of said main cover; and iii. a gasket disposed between said first flat flange of said main cover and said access cover, and comprising a first portion of a cord seal including a first cord seal groove disposed in an interface between said main cover and said access cover; a second portion of said cord seal comprised of a cord seal block including a second cord seal groove; wherein said cord seal block is in contact with said first portion of said cord seal, thereby forming a cord seal passageway between said first cord seal groove of said first portion of said cord seal and said second cord seal groove of said cord seal block;

c. a level switch assembly comprising a hook-shaped hanger rod engaged with said engagement feature of said cover assembly, and at least one level switch attached to said hook-shaped hanger rod; and d. a pump disposed in said basin and operatively connected by a discharge pipe to said first opening of said main cover.

4. The sewage handling system as recited in claim 3, wherein said at least one level switch is a float switch.

5. The sewage handling system as recited in claim 3, wherein said hanger rod is L-shaped.

6. The sewage handling system as recited in claim 3, further comprising a second level switch attached to said hook-shaped hanger rod.

7. A cover assembly for covering a vessel, said cover assembly comprising:

a. a main cover comprising at least a first opening connectable to a pipe, a second opening surrounded by a first flat flange, and an engagement feature comprised of at least one channel transitioning to a first cavity;

b. an access cover comprising a second flat flange removably secured to said first flat flange of said main cover; and c. a gasket disposed between said first flat flange of said main cover and said second flat flange of said access cover, and comprising a first portion of a cord seal including a first cord seal groove disposed in an interface between said main cover and said access cover; a second portion of said cord seal comprised of a cord seal block including a second cord seal groove; wherein said cord seal block is in contact with said first portion of said cord seal, thereby forming a cord seal passageway between said first cord seal groove of said first portion of said cord seal and said second cord seal groove of said cord seal block.

8. The cover assembly as recited in claim 7, wherein said access cover is further comprised of a cord seal riser mated against said cord seal block.

9. A cover assembly for covering a vessel, said cover assembly comprising:

a. a main cover comprising at least a first opening connectable to a pipe, a second opening surrounded by a first flat flange, and an engagement feature comprised of at least one channel transitioning to a first notch;

b. an access cover removably secured to said first flat flange of said main cover; and c. a gasket disposed between said first flat flange of said main cover and said access cover, and comprising a first portion of a cord seal including a first cord seal groove disposed in an interface between said main cover and said access cover; a second portion of said cord seal comprised of a cord seal block including a second cord seal groove; wherein said cord seal block is in contact with said first portion of said cord seal, thereby forming a cord seal passageway between said first cord seal groove of said first portion of said cord seal and said second cord seal groove of said cord seal block.

10. The cover assembly of claim 9, further including a level switch assembly comprising a hook-shaped hanger rod engaged with said engagement feature of said cover assembly, and at least one level switch attached to said hook-shaped hanger rod.

11. The cover assembly of claim 10, wherein said at least one level switch is a float switch.

12. The cover assembly of claim 10, wherein said hanger rod is L-shaped.

* * * * *